US006283474B1

(12) United States Patent
de Keller

(10) Patent No.: US 6,283,474 B1
(45) Date of Patent: Sep. 4, 2001

(54) METHOD FOR PLAYING A CASINO GAME

(76) Inventor: David Guy de Keller, Sweet Valley Farm, Soetvlei Ave., Constantia 7800, Cape Town (ZA)

( * ) Notice: Subject to any disclaimer, the term of this patent is extended or adjusted under 35 U.S.C. 154(b) by 0 days.

(21) Appl. No.: 09/239,175

(22) Filed: Jan. 28, 1999

(51) Int. Cl.[7] ..... A63F 3/08
(52) U.S. Cl. ..... 273/274; 273/292; 463/12
(58) Field of Search ..... 273/274, 292, 273/303; 463/11–12, 13

(56) References Cited

U.S. PATENT DOCUMENTS 5,265,882 * 11/1993 Malek .
5,288,077 * 2/1994 Jones .
5,364,105 * 11/1994 Jones .
5,377,973 * 1/1995 Jones .
5,395,120 * 3/1995 Malek .
5,417,430 * 5/1995 Breeding .
5,482,289 * 1/1996 Weingardt .
5,577,731 * 11/1996 Jones .

* cited by examiner

*Primary Examiner*—Benjamin H. Layno
*Assistant Examiner*—V K Mendiratta
(74) *Attorney, Agent, or Firm*—Philip J. Anderson; Anderson & Morishita

(57) ABSTRACT

A modified method for playing Blackjack is set forth wherein the players each make a first wager to participate in the Blackjack game and a second wager, the second wagers accumulated to form a pot. The pot, less any levy for the casino, is awarded to the player according to the various embodiments thereof to the player(s) (i)having a final hand count closest to but not exceeding 21, (ii) the highest count based upon the initial two cards dealt to the player or (iii) the player(s) having a Blackjack. A portion of the pot may be allocated to form a jackpot awarded to players based upon there obtaining a predetermined holding.

6 Claims, 2 Drawing Sheets

10
12
12
12
12
12
12
22
24
16
16
16
16
16
16
18
18
18
18
18
18
18
POT LUCK
POT LUCK
POT LUCK

3 X 4'S SUITED = PROGRESSIVE JACKPOT

3 X 4'S UNSUITED = MINOR JACKPOT

2 X 4'S SUITED = $ 100

2 X 4'S UNSUITED = $ 50

METHOD FOR PLAYING A CASINO GAME

FIELD OF THE INVENTION

The present invention relates to methods for playing casino games using playing cards. More particularly it relates to Blackjack and Blackjack-like games.

BACKGROUND

Blackjack, also known as "21" is popular and has been played in casinos for many years. The rules of the game of Blackjack are well known to those skilled in the art.

The rules, with a few exceptions, are fairly universal. Some alternate rules of the basic Blackjack game require the dealer to hit a soft 17 (a hand count according to the rules of Blackjack of 17 including an Ace which counts as one or eleven), limit the hand counts to which a player can double down to ten or eleven, and limit the number of times a hand can be split are but a few examples. These alternate or modified rules are well known as well.

Recently, Blackjack-like games such as SPANISH 21® described in U.S. Pat. No. 5,615,888 issued Apr. 1, 1997 to Lofink et al the disclosure of which is hereby incorporated by reference, have been created. Some of these games include the feature of an additional or side wager to fund and participate in a jackpot feature for the game based upon the player's hand. In these games the side wager is optional and is not mandatory As hereinafter used, the term Blackjack or Blackjack-like or Blackjack-style game refers not only to the basic Blackjack game with its variations but also the aforementioned and other games which are like Blackjack.

Other variations include that described in Le Vasseur U.S. Pat. No. 5,257,789 where a player can play a single hand against multiple dealer's hands and String U.S. Pat. No. 5,649,705 where a player can elect to wager upon whether the player or dealer will obtain a winning hand.

These Blackjack games are banked by the house (e.g. casino). This means that the player is playing against the dealer who represents the house. Wagers are paid to a player having a winning outcome by the dealer (the "house") and losing wagers are collected by the dealer for the house. Further nearly all winning outcomes are paid at even money, i.e. 1:1, except for a Blackjack (an Ace with a ten value card) which typically pays 3:2.

In contrast to Blackjack, the game of Poker and its variations is a contest between the players with the highest ranking hand winning the pooled wagers (often referred to as the "pot"), less a levy or "rake" taken by the house dealer for hosting the game. Unlike Blackjack the game of Poker generates social interplay in the form of friendly or not so friendly rivalry, humor, banter and by play between the players which contributes to the excitement of the game.

It is an object of the method of the present invention to inject the excitement associated with Poker into the game of Blackjack.

It is a further object of the method of the present invention to increase the revenue received by the casino for Blackjack.

SUMMARY OF THE INVENTION

There is provided, therefore, according to the present invention an improved method for the play of Blackjack or a Blackjack-style game where the players, in addition to their normal first or ante wager to play a hand of Blackjack, each make a second wager. The second wagers are aggregated to form a pot. At the conclusion of the Blackjack hand resolved according to the rules thereof, the dealer compares, for all players remaining in the hand, all players' hand outcomes to determine which players' outcome hand(s) are closest to 21. If all players have previously "busted" by exceeding 21 the pot is carried over. For the player having a final outcome hand count at or closest to 21, he/she is awarded the pot. If two or more players tie for the pot, the pot is shared pro rata.

To provide additional revenue to the casino the casino may exact a rake on the pot such as 1%, one dollar or the like.

As but a further feature a portion of each pot may be allocated to form a progressive jackpot awarded to a player having a predetermined final hand outcome.

As can be appreciated, by providing for the making of a second wager, the element of competition of Poker is injected into a Blackjack game. Further a player may lose their Blackjack hand but win the pot or vice versa, also increasing the excitement of the game. Also the pot can be used to increase the revenue for the table by exacting a levy or rake on each pot and by using the pot to fund a progressive jackpot. Where a jackpot is used, a player may win and lose any combination of the Blackjack game, the pot or the jackpot. This increases the excitement for the game.

BRIEF DESCRIPTION OF THE DRAWINGS

These and other features and advantages of the present invention will become appreciated as the same becomes better understood with reference to the specification, claims and drawing wherein:

DESCRIPTION

The present invention comprises a method for playing a Blackjack-type wagering game which utilizes at least one deck of playing cards. While the present Blackjack-type wagering game will be described for use at a gaming table with one or more players, it should be noted that the game can be adapted to be played on an electronic or video gaming machine with multiple player stations all playing against a single dealer and all players competing between one another for a pot of pooled wagers.

Figure 1:
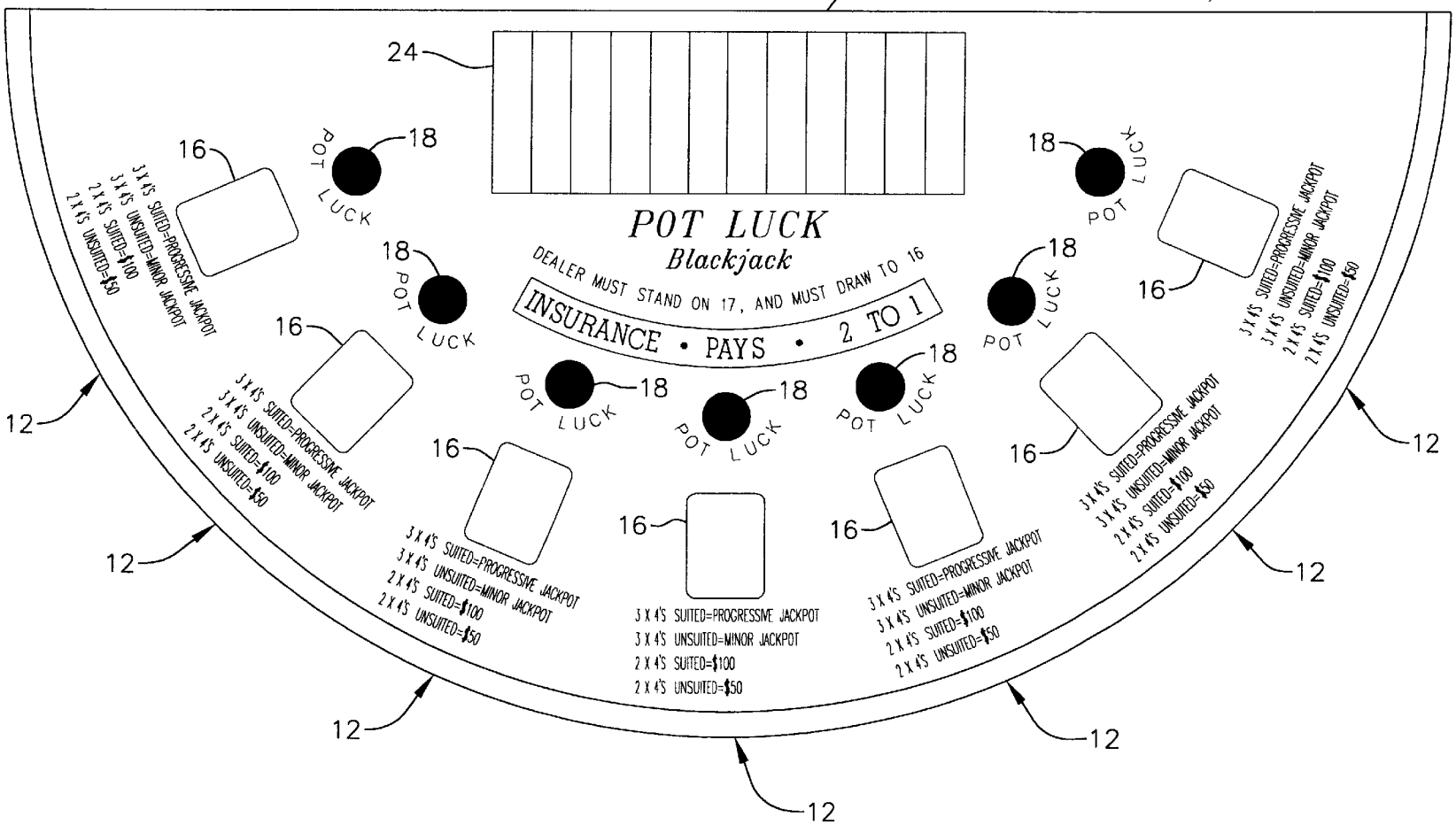
FIG. 1 shows an example of a layout for the play of the game according to the present method.

Referring to FIG. 1, a table layout 10, upon which the modified Blackjack game of the present invention is played, is schematically shown. The layout is preferably mounted on top of a conventional type gaming table (not shown). A plurality of playing locations 12 are provided along the periphery of the table. Typically, there are seven playing locations. Each of the playing locations has the following designated areas associated therewith betting areas 16 and 18. A dealer's location 22 is provided and has a chip rack 24 to contain the chips paid and collected during the play of the game.

A round of the modified Blackjack game of the present invention is begun by each player placing first and second wagers, the first wager placed in the betting area 16 and the second wager in the betting area 18 respectively. The wager on the betting area 16 constitutes the traditional wager associated with the game of Blackjack, namely, a house banked contest between each player's hand and the dealer's hand. The wager on the betting area 18 constitutes a feature found in the modified method of play of the present invention, namely, the pot bet.

The second wagers placed on the betting area 18 have no connection to the outcome of the dealer's hand.

The second wagers placed in areas 18 may be combined by the dealer into a pot accumulated at the center of the table.

Once the players have placed their first and second wagers the dealer deals two cards to each of the players and to the dealer. The round or hand of Blackjack then proceeds in a manner known in the art and according to the rules of the game. After the initial deal, the dealer first settles with each player separately with regard to their wagers on the betting areas 16. Each player in turn, may either "stand" (on his first two cards, or at any later time), or may request additional card(s). A player may continue to draw additional cards, but once he stands he may draw no more cards. All additional cards received by the player are usually dealt face up. If an additional card puts the player's hand count over 21, he must show his cards and the dealer collects his first and second wagers. This player has busted and is no longer in the hand. When every player, except the dealer, has either completed their hand to a final holding represent a final count not exceeding twenty-one or busted and dropped from the hand, the dealer turns up his face-down card. Casino rules may specify that the dealer must take additional cards as long as his total is 16 or less and must stand when his total reaches 17 or more. If the dealer goes over 21 he loses the hand and pays each player remaining in the hand. When the dealer completes his hand, he collects from each player having a lower count, pays each player having a higher count, and has a stand-off (push or draw) with each player having the same count.

Under the rules of Blackjack, a player has the option regarding his wager on the betting area 16, if his first two cards are a pair, such as two sevens or two Jacks, to play them as two different hands. When the player who 'split' turn comes, he turns both cards face up and places another wager in the amount of his first wager on betting area 16 and an additional second wager in area 18 for each split hand. The player then plays and completes each of his hands separately.

All of the conventional features of the Blackjack-style game as they apply to the wager on the betting area 16 may be utilized by the player in the method of the present invention. A player may 'double down' and take 'insurance' on his hand as the conventional manner of play according to what the rules will permit.

Having settled all bets in relation to the first wagers placed in the betting areas 16 for Blackjack the dealer then once again examines each player's hand in relation to the second wagers. Those players who busted are no longer in the hand and do not qualify for the pot accumulated from the second wagers. Players that 'split' their cards into two hands qualify for the pot/pooled wagers in terms of both hands. Alternatively, only one of the hands, e.g. the first hand qualifies for the pot/pooled wagered. The dealer determines which player(s) has a count of 21 or alternatively which of the players has the highest count closest to 21 and awards all the aggregated second wagers representing the pot to such player less a levy or vigorish (often referred to as a "rake"). In the event of two or more players hold the highest count, the pot is shared on an equal basis. In the event of all players 'busting,' having a total in excess of 21, a levy is deducted from the winnings and the remainder of the winnings are carried forward to the next hand.

In a preferred embodiment of the modified method of playing the game, the second wagers placed in the betting areas 18 are combined with a jackpot feature. The jackpot paytable is comprised of a series of ranked hands with an ascending order of fixed odds or alternatively the jackpot will be a progressive jackpot. In the latter case the major jackpot will be represented by the current total displayed on a win meter and the minor jackpots a combination of a percentage of the major jackpot total and fixed amounts. The betting areas 18 are drawn onto the playing surface/layout 10 or may be defined by sensors which are either magnetic, or fitted with optical eyes or capacitors to determine the placing of wagers. When the second wagers are combined with a jackpot feature a portion is deducted from the pot winnings to fund the jackpot. Table A as illustrated below is a specimen paytable of a jackpot feature to be combined with the pot bets in the betting areas 18.

TABLE A

| | |
|---|---|
| Three suited 4s | Progressive Jackpot |
| Three unsuited 4s | 50% of Jackpot |
| Two suited 4s | 25% of Jackpot |
| Two unsuited 4s | 10% of Jackpot |

Alternatively, the awards could be fixed amounts such as suggested in Table B below.

TABLE B

| | |
|---|---|
| Three suited 4s | $15,000 |
| Three unsuited 4s | $10,000 |
| Two suited 4s | $5000 |
| Two unsuited 4s | $500 |

Figure 2:
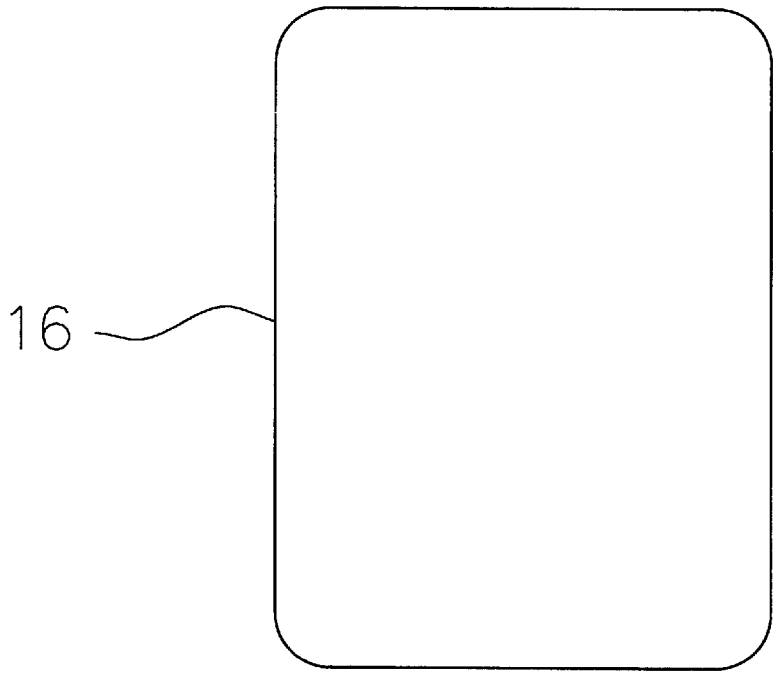
FIG. 2 shows an enlarged vied of one of the player's bettering areas with certain payoffs listed therefor.

FIG. 2 illustrates an enlarged view of the betting area 16 which may have indicated adjacent thereto the various jackpot combinations and the payoffs for each, A player remaining in the hand (he has not previously busted) who has a predetermined jackpot holding such as those set forth in Table A is awarded the corresponding jackpot regardless of whether or not he wins the Blackjack first wager or the pot bet. All wagers and awards are separately determined. In accordance with the method of the present invention a player may lose both first and second wagers yet qualify for a payout on the jackpot feature.

It is to be understood that the jackpot holdings and payouts of Tables A and B are suggestive only in that the casino may adopt different holdings and payouts.

As a further embodiment, the second wagers accumulated to form the pot could be awarded based upon (i) the highest count of the first two cards or (ii) the player(s) having a Blackjack.

As yet a further embodiment, a separate jackpot wager could be made in addition to the first and second wagers. Thus a player, under this embodiment, would be required to make a first wager to participate in the basic Blackjack game, a second wager to form the inter-player pot and a separate jackpot wager directed to the jackpot component of the game. The levy or rake for the casino could be taken from the separate jackpot wagers thus leaving the accumulated pot as the aggregation of the second wagers. To accommodate the three separate wagers, three areas would be denoted on the layout therefor.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

I claim as follows:

1. A method for playing a modified Blackjack game wherein each player makes a first wager to participate in the game, said player's first wagers resolved by comparing each player's final hand against a dealer hand according to the rules of the game with player winning their first wager, tying with the dealer, losing by having a hand value less than the dealer or busting by having a hand value exceeding a hand count of twenty-one, the method comprising:

each player making a mandatory second wager, said player second wagers aggregated to form a pot;

disqualifying players who bust from vying for the pot;

comparing all players' hands who have not been disqualified to determine which players' hand(s) are closest to twenty-one;

awarding the pot to the player having the hand value closest to twenty-one and splitting the pot between two or more players tying with equal hand values closest to twenty-one; and if all players have been disqualified by busting, carrying over said pot to the next succeeding hand.

2. The method of claim 1 further including removing a levy from the pot prior to awarding the.

3. The method of claim 1 further including allocating a portion of the pot to a jackpot and awarding at least a portion of the jackpot to a player having a predetermined hand.

4. The method of claim 3 further including the jackpot to a player having one of a predetermined schedule of outcome hands.

5. The method of claim 4 including awarding the jackpot to a player according Table A,

TABLE A

| Outcome | Award |
|---|---|
| Three suited 4s | Entire Jackpot |
| Three unsuited 4s | 50% of Jackpot |
| Two suited 4s | 25% of Jackpot |
| Two unsuited 4s | 10% of Jackpot. |

6. The method of claim 4 including awarding the jackpot to a player according to Table B,

TABLE B

| | |
|---|---|
| Three suited 4s | $15,000 |
| Three unsuited 4s | $10,000 |
| Two suited 4s | $5000 |
| Two unsuited 4s | $500. |

* * * * *